United States Patent [19]

Glöckner et al.

[11] 4,169,399

[45] Oct. 2, 1979

[54] ELECTRONIC DEVICE FOR CONTROLLING THE FUNCTION OF AN ELECTRONIC YARN CLEARER

[75] Inventors: Rolf Glöckner, Egg; Hans Späni, Zürich; Hansruedi Stutz, Dietlikon, all of Switzerland

[73] Assignee: Gebrüder Loepfe AG, Wetzikon, Switzerland

[21] Appl. No.: 914,886

[22] Filed: Jun. 12, 1978

[30] Foreign Application Priority Data

Jun. 17, 1977 [CH] Switzerland ..... 7447/77

[51] Int. Cl.[2] ..... B26D 5/38

[52] U.S. Cl. ..... 83/361; 28/227; 83/371

[58] Field of Search ..... 83/361, 371; 28/227; 356/159, 160, 238

[56] References Cited

U.S. PATENT DOCUMENTS

| | | | |
|---|---|---|---|
| 3,122,956 | 3/1964 | Jucker | 83/361 |
| 3,631,354 | 12/1971 | Werffeli | 28/227 X |
| 3,892,951 | 7/1975 | Stutz | 28/227 X |
| 4,058,962 | 11/1977 | Spescha | 28/227 X |

*Primary Examiner*—Frank T. Yost

*Attorney, Agent, or Firm*—Werner W. Kleeman

[57] ABSTRACT

The invention is concerned with an electronic device for testing and controlling the clearing action of an electronic yarn clearer. The device comprises an individual fault measuring circuitry connected to the yarn sensing head of the yarn clearer for detecting yarn faults such as thick and thin places, and selector means for separating the non-tolerable faults from the rest. By comparing the output of the device and the output of the yarn clearer, the non-tolerable faults which have not been cut-out by the yarn clearer are detected. It is possible to eliminate also the latter faults from the yarn by actuating the severing device of the clearer.

10 Claims, 4 Drawing Figures

ELECTRONIC DEVICE FOR CONTROLLING THE FUNCTION OF AN ELECTRONIC YARN CLEARER

BACKGROUND OF THE INVENTION

The present invention relates to an electronic device for controlling the function of an electronic yarn clearer which comprises a sensing device producing a sensing signal representative of a transverse dimension of the traveling yarn, or the deviations of the transverse dimension, an evaluating or evaluation circuit operatively connected to the sensing device for detecting and evaluating yarn faults and producing yarn severing pulses upon appearance of undesirably great yarn faults.

Electronic yarn or thread clearers are used on yarn production machines, in particular automatic winding machines, for eliminating undesired yarn faults, such as thick places, from the yarn. Such thick places are yarn sections exceeding a defined thickness or length and thickness. Setting devices are provided for feeding in the parameters necessary for evaluating the yarn faults, which setting devices may furnish one or several control voltages dependent on the construction of the yarn clearer.

An electronic yarn clearer comprising several signal channels and electronic circuitry for testing and setting the functions of the yarn clearer is disclosed in Swiss Pat. No. 531,459, U.S. Pat. No. 3,758,216 and corresponding other patents. Such electronic circuitry enables one to very accurately set an electronic yarn clearer, however requires some skill and a relatively great expenditure of time since the single signal channels must be set one after another.

SUMMARY OF THE INVENTION

It is an objective of the present invention to facilitate monitoring and controlling the yarn clearer units, and to enable untrained personnel to perform those operations.

It is a more specific object of the invention to provide a device for automatic monitoring and/or positively controlling the function of an electronic yarn clearer or the clearing units thereof.

These objects are realized by the inventive electronic control device comprising fault measuring means whose input is the sensing signal, for generating fault measuring signals representative of the magnitude values of the yarn faults; fault selector means whose input signals are fault measuring signals, for furnishing output signals only upon appearance of fault measuring signals whose magnitude values or magnitudes exceed predetermined boundary values; and at least one gate circuit for logically combining the output signals of the fault selector means and the yarn severing pulses.

BRIEF DESCRIPTION OF THE DRAWINGS

The invention will be better understood and objects other than those set forth above will become apparent upon consideration of the following detailed description thereof which refers to the annexed drawings wherein.

DETAILED DESCRIPTION OF THE INVENTION

Figure 1:
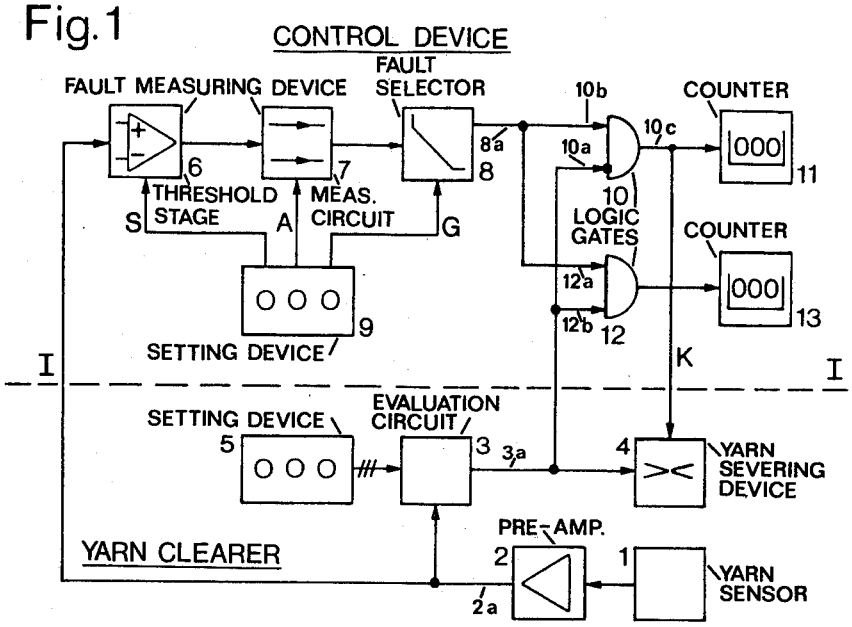
FIG. 1 is a block schematic of a first embodiment of the inventive control device and an electronic yarn clearer to be controlled.

With reference to FIG. 1, an electronic yarn clearer which may be of conventional construction is represented by components 1–5, comprising a central setting device 5 and one of a multiplicity of clearer units 1–4 consisting of a yarn sensing device 1, a pre-amplifier 2, an evaluation circuit 3 and a yarn severing device 4.

Sensing device or yarn sensor 1 may comprise an optoelectrical or capacitive transducer for generating an electrical sensing signal representative of a transverse dimension, e.g. the instantaneous diameter, cross-sectional area or mass per unit length of the yarn. The sensing signal is amplified in D.C. or A.C. pre-amplifier 2 and supplied to measuring or evaluation circuit 3 comprising two or more parallel signal channels. In the signal channels, the sensing signals whose amplitude exceeds a predetermined threshold value (thick places), or is smaller than another threshold value (thin places), are processed to fault measuring signals. In the event of undesirably great yarn faults, evaluation circuit 3 produces an output signal, i.e. the so-called yarn severing pulse which actuates severing device 4 for severing the yarn or the like.

In order to set the yarn clearer with respect to the various yarns to be cleared, the responsiveness of evaluation circuit 3 may be adjusted by means of control voltages supplied by setting device 5. In the present case, three control voltages are provided for defining, firstly, the above-mentioned threshold value for the thick places, and secondly the parameters defining the clearing boundary, that is a line in the thickness versus length diagram which separates the small and tolerable faults from the heavy faults which are to be eliminated.

In FIG. 1, the control device or circuitry comprising the components 6–13 is separated from yarn clearer 1–5 by the dashed line I—I. Control device 6–13 makes possible, firstly, passive monitoring of yarn clearer 1–5 or any clearer unit 1–4 thereof, and secondly—at the same time or alternatively—active control by actuation of yarn severing device 4. Such an active control is substantial in the practice of yarn clearing since generally the responsiveness of the clearer units 1–4, and thus the clearing effect is reduced during prolonged working durations. That means that more and more undesirable yarn faults pass the severing device 4 without producing a severing pulse or being eliminated.

Control circuitry 6–13 comprises a fault measuring device 6,7 composed of threshold responsive stage 6 and serially connected measuring circuit 7. Threshold responsive stage 6 may be structured as a comparator comprising a differential amplifier and is operatively connected to the output 2*a* of pre-amplifier 2. Serially connected to measuring circuit 7 is a fault or clearing boundary selector 8 which may be a monoflop having a controllable response threshold. The series connection of components 6,7 and 8 may be a duplicate of evaluation circuit 3 of yarn clearer 1–5, or it may be arranged otherwise. Setting device 9 supplies three control voltages or signals S, A and G to the circuits 6,7 and 8, respectively. The structure and functioning of circuits 6–9 will still be described in detail with reference to FIG. 2.

Clearing boundary selector 8 furnishes a control pulse only upon appearance of an undesirably large yarn fault.

A first gate circuit 10 comprising an AND-gate having two inputs 10*a* and 10*b*, of which input 10*a* is a negated input and is connected to the output 3*a* of evaluation circuit 3 of the yarn clearer, whereas the other input 10*b* is connected to the output 8*a* of clearing boundary selector 8. The output 10*c* of the first gate circuit 10 is connected firstly with a first counting device 11 and secondly with the yarn severing device 4 of the yarn clearer, as shown.

In case the electronic yarn clearer 1–5 is set and functioning correctly, and works in exact correspondence with the control circuitry and particularly with the circuits 6–9 thereof, in any case a yarn severing pulse from evaluation circuit 3 and a control pulse at the output terminal or output 8*a* of clearing boundary selector 8 should appear at the same instant. In this event, the first gate circuit 10 does not generate an output pulse. However, when the clearing effect of electronic yarn clearer 1–5 has diminished by ageing or otherwise, a control pulse may be generated with no severing pulse occurring. In that event, first gate circuit 10 applies a correction pulse on output conductor K which actuates yarn severing device 4 and causes the yarn to be cut. The correction pulse is at the same time registered by the first counting device 11.

It is advisable to switch on counting device 11 for a fixed time interval, e.g. an hour, or for the period in which a bobbin or cross-wound coil or package is wound-up. The number of registered correction pulses enables an operator to detect a difference between the functioning of the circuits 3 and 5 of the yarn clearer, on the one hand, and the circuits 6–9 of the control device, on the other hand.

A second gate circuit 12 is arranged as an AND-gate having two inputs 12*a* and 12*b*, the first input 12*a* of which is connected to the output 8*a* of clearing boundary selector 8 and the second input 12*b* of which is connected to the output 3*a* of evaluation circuit 3 of the yarn clearer. Connected in series with the second gate circuit 12 is a second counting device 13 which registers any yarn faults for which a control pulse as well as a severing pulse is generated.

Comparing the counts of both counters 11 and 13, an operator can assess the relation between the number of undesired yarn faults not eliminated by yarn clearer 1–5, and the number of such faults really cut-out by the yarn clearer.

Figure 2:
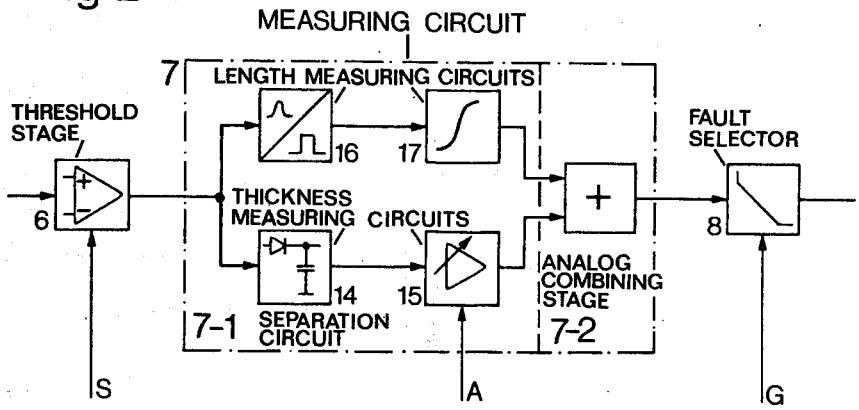
FIG. 2 shows one of the blocks of FIG. 1 in more detailed representation.

FIG. 2 shows the circuits 6,7 and 8 with measuring circuit 7 in detail, and the connections of the control voltages or signals S, A and G.

Threshold responsive stage 6 is supplied with threshold control voltage S from setting device 9. The voltage S determines the amplitude of the sensing signal furnished by pre-amplifier 2 which is the lower limit or threshold for the detection of the yarn faults. This means that threshold responsive stage 6 passes only signals whose amplitudes are above that limit. In the following context, those signals are termed fault signals.

Measuring circuit 7 following threshold responsive stage 6 comprises a signal separation circuit 7-1 and a serially therewith connected analog combining stage 7-2. Signal separation circuit 7-1 comprises thickness measuring circuits 14,15 and in parallel therewith length measuring circuits 16,17 comprising a signal former 16 and an integrator 17 in series connection. Signal former 16, e.g. a zero threshold Schmitt-trigger, transforms the fault signal from threshold responsive stage 6 into a rectangular pulse of the same duration, however of an amplitude independent of the fault signal amplitude. Integrator 17 transforms the rectangular pulse into a triangle pulse whose amplitude is substantially proportional to the duration of the fault signal and which may be termed the length measuring signal.

The thickness measuring circuits 14,15 comprise a peak detector 14 and a therewith serially connected controllable amplifier 15 which is supplied with an amplitude control voltage A from setting device 9. Peak detector 14 furnishes a single pulse having a tilted leading edge and a flat top whose height corresponds to the amplitude of the fault signal. Such single pulse is amplified by amplifier 15, more or less in relation to the amplitude control signal A, and transformed into the thickness measuring signal.

The thickness and length measuring signals are combined or added in the following analog combining stage 7-2 which may be an adding amplifier, resulting in an analog fault measuring signal whose amplitude is a measure of the magnitude or "weight" of the yarn fault. The analog fault measuring signal is fed to clearing boundary selector 8 which sets a lower limit to the fault measuring signals depending upon the boundary control voltage G from setting device 9. In case the amplitude of the fault measuring signal exceeds said lower limit a control pulse is generated which is processed as mentioned in the foregoing context.

The combined action of fault measuring device 6,7 and clearing boundary selector 8 results in a clearing boundary as schematically represented by the sloping line in block 8.

It may be noted with respect to control device 6–13 that another combining stage 7-2 may be provided in place of an adding amplifier, e.g. a multiplying stage producing the analog fault measuring signal as a product of the length and thickness measuring signals. Alternatively, measuring circuit 7 may be a filter circuit the response of which may be varied by altering the time-constant thereof.

Figure 3:
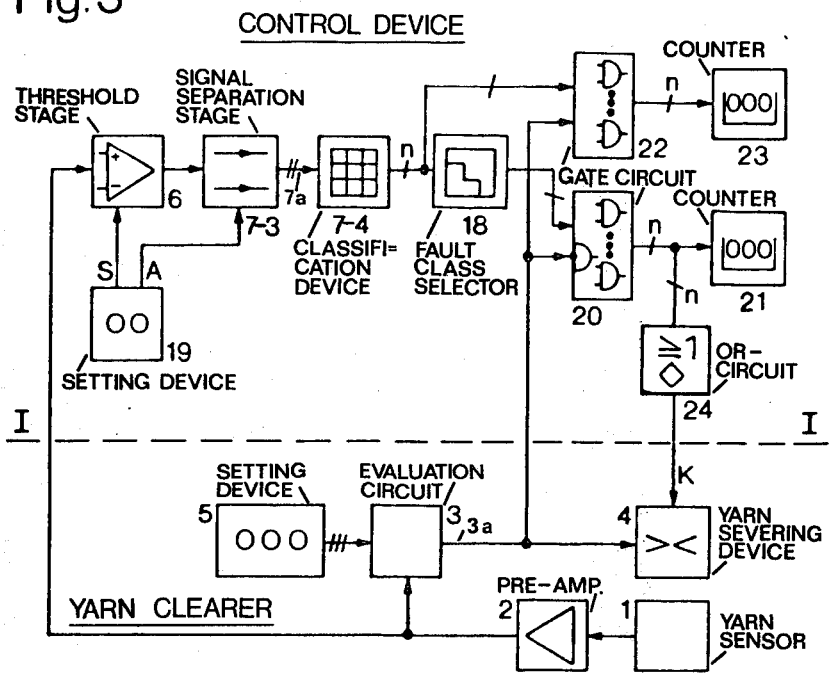
FIG. 3 is a block schematic of a second embodiment.

The embodiment of the control device shown in FIG. 3 differs from the one described above with reference to FIGS. 1 and 2 in that the analog fault measuring signals are transformed into and processed as digital signals. The electronic yarn clearer 1–5 may be arranged as stated in the foregoing context.

The control device of FIG. 3 comprises the functional components 6,7-3,7-4, and 18–24. The fault measuring device 6,7-3,7-4 consists of a threshold responsive stage 6, a thereto serially connected signal separation circuit 7-3 which is represented in detail in FIG. 4 and furnishes digital fault measuring signals on the two output lines 7*a* thereof, and a classification device 7-4 which is connected to those two output lines 7*a* and whose inputs are the digital fault measuring signals. Serially connected to classification device 7-4 is a fault class selector 18 comprising n classes and having n output lines.

Setting device 19 furnishes a threshold control voltage S to threshold responsive stage 6 and an amplitude control voltage A to signal separation circuit 7-3 which produces a digital length measuring signal as well as a digital area measuring signal upon appearance of a yarn fault. These fault measuring signals appearing in pairs are classified in classification device 7-4, dependent upon the length and length cross-sectional area of the yarn faults, or alloted to one of the n classes. Upon appearance of a yarn fault or the corresponding fault measuring signal, a classified fault measuring signal appears on the output line of classification device 7-4 which represents the class in question. The shape and magnitude of the classified fault measuring signal are independent of the magnitude values of the digital fault measuring signals furnished by signal separation circuit 7-3.

The number n of the classes may be chosen at will; following a known and frequently used classification scheme, one may choose four classes for the length classification and also four classes for the cross sectional or area classification; that means a total of $4 \cdot 4 = 16$ classes.

Fault class selector 18 is followed by a serial connection comprising a first gate circuit 20 and an n-fold first counting device 21. Gate circuit 20 consists of n AND-gates arranged in parallel, the first input of each AND-gate being individually connected to one of the n outputs of fault class selector 18. On the other hand, the second inputs of gate circuit 20 are connected through a negator to the output 3*a* of evaluation circuit 3 of yarn clearer 1-5. Counting device 21 comprises n single counters each of which is connected to one of the n outputs of gate circuit 20, and thus is correlated to one of the n classes of classification device 7-4. In addition, the n output lines lead to a wired OR-circuit 24 whose output conductor K is connected to yarn severing device 4.

A second gate circuit 22 which comprises n AND-circuits in parallel is connected, at the first inputs thereof, to the n outputs of classification device 7-4. The n output lines of second gate circuit 22 lead to a second counting device 23 which also comprises n single counters each of which is adjoined to one of said n output lines. A second input of second gate circuit 22 is connected to the output 3*a* of evaluation circuit 3.

The first gate circuit 20 responds only when, on appearance of a classified fault measuring signal from fault class selector 18, no yarn severing pulse is simultaneously generated by evaluation circuit 3. That means the first gate circuit 20 produces classified counting pulses for all essential yarn faults not detected and cut-out by the electronic yarn clearer 1-5. Those classified fault signals are registered in the first counting device 21, separately in their respective classes. Since counting device 21 registers only the essential yarn faults which have not been detected by yarn clearer 1-5, such a registration enables an operator to judge the functioning of the yarn clearer. Simultaneously with each response of counting device 21, yarn severing device 4 is actuated for cutting-out a yarn fault which has not been detected by yarn clearer 1-5.

Fault class selector 18 may be construed in a very simple manner, adjoining an individual mechanical or electronic closing contact to each of the n lines coming from classification device 18, which contacts may be manually closed by means of a keyboard comprising n keys. On the output side of fault class selector 18, each of said closing contacts is connected to one of n output lines leading to first gate circuit 20. By pressing the corresponding keys those classes of yarn faults may be chosen which are to be cut-out by yarn severing device 4.

Such inventive method of yarn clearing control is of particular interest for a conventional analog yarn clearer since classification of the yarn faults and selection of the classes of the undesirable yarn faults has generally been introduced in order to correspondingly set the control voltages of the yarn clearer. However, the latter because of its analog conception is able to work with a steady fault boundary line rather than an unsteady one prescribed by classification, such as represented by the stepped line in block 18.

The above-mentioned second gate circuit 22 with second counting device 23 registers all yarn faults, filed in classes, for which yarn clearer 1-5 generates a severing pulse; that is the main quantity of the undesirably large yarn faults which may not be tolerated. Such classified counting of the undesirably large yarn faults enables one to judge the quality of the yarn with respect to these rare faults.

Figure 4:
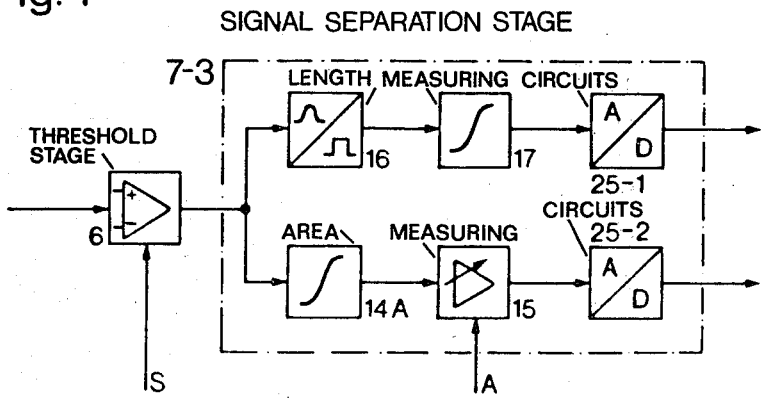
FIG. 4 illustrates one of the blocks shown in FIG. 3 in more detailed representation.

FIG. 4 shows an embodiment of a signal separation circuit 7-3 comprising—similarly as signal separation circuit 7-1, FIG. 2,—two parallel series of measuring circuits, namely length measuring circuits 16,17,25-1 and area measuring circuits 14A,15,25-2. Each of these circuit series is terminated by an A/D-converter 25-1 and 25-2, respectively, transforming the analog measuring signals from the preceding circuits into digital signals.

The circuits 16 and 17 of the first circuit series may be arranged in the same manner as length measuring channel 16,17 shown in FIG. 2.

In place of the second circuit series, thickness measuring circuits 14,15 as shown in FIG. 2 and terminated by an A/D-converter output stage might be provided. However, FIG. 4 shows, as a modification, area measuring circuits comprising an integrator 14A as the first circuit which forms the time integral of the fault signal furnished by threshold responsive stage 6 and representing the area thereof.

While there are shown and described present preferred embodiments of the invention, it is to be distinctly understood that the invention is not limited thereto but may be otherwise variously embodied and practiced within the scope of the following claims. Accordingly,

What we claim is:

1. An electronic device for controlling the function of an electronic yarn clearer which comprises a sensing device for producing a sensing signal representative of a transverse dimension or the deviations of a transverse dimension of a traveling yarn, an evaluation circuit operatively connected to the sensing device for detecting and evaluating yarn faults and producing yarn severing pulses upon appearance of undesirably great yarn faults, and a yarn severing device operatively connected to the evaluation circuit; the electronic control device comprising:

fault measuring means whose input is the sensing signal, for generating fault measuring signals representative of the magnitude values of the yarn faults;

fault selector means whose input signals are fault measuring signals, for furnishing output signals only upon appearance of fault measuring signals whose magnitude values exceed predetermined boundary values; and at least one gate circuit for logically combining the output signals of the fault selector means and the yarn severing pulses.

2. The electronic device as defined in claim 1, comprising first AND-circuit means combining the output signals of the fault selector means and negated output signals of the evaluation circuit.

3. The electronic device as defined in claim 1, comprising second AND-circuit means combining the output signals of the fault measuring means and output signals of the evaluation circuit.

4. The electronic device as defined in claim 1, wherein the output of each gate circuit is individually connected to a counting device.

5. The electronic device as defined in claim 2, wherein the output of the first AND-circuit means is operatively connected to the yarn severing device.

6. The electronic device as defined in claim 1, wherein the fault measuring means and the fault selector means are structured as analog circuits.

7. The electronic device as defined in claim 1, wherein the fault measuring means comprises means for converting analog fault measuring signals into digital fault measuring signals.

8. The electronic device as defined in claim 7, wherein the fault measuring means comprises a classification device connected to an output of the converting means for generating classified fault measuring signals.

9. The electronic device as defined in claim 2, wherein the fault measuring means comprises means for converting analog fault measuring signals into digital fault measuring signals, the fault measuring means comprises a classification device connected to an output of the converting means for generating classified fault measuring signals, a fault class selector operatively connected to an output of the classification device and provided with means for manually selecting classes of undesirably large yarn faults.

10. The electronic device as defined in claim 1, wherein the fault measuring means comprises a threshold responsive stage and a measuring circuit comprising two parallel measuring channels one of which is structured for measuring the length of the yarn faults.

* * * * *